US007284614B2

(12) United States Patent
Van Helvoirt et al.

(10) Patent No.: US 7,284,614 B2
(45) Date of Patent: Oct. 23, 2007

(54) WELLBORE SYSTEM FOR SIMULTANEOUS DRILLING AND PRODUCTION

(75) Inventors: Laurens Cornelis Van Helvoirt, SV Drunen (NL); Hugh Edward Sheehy, GD Rijswijk (NL)

(73) Assignee: Shell Oil Company, Houston, TX (US)

( * ) Notice: Subject to any disclaimer, the term of this patent is extended or adjusted under 35 U.S.C. 154(b) by 521 days.

(21) Appl. No.: 10/490,506

(22) PCT Filed: Sep. 23, 2002

(86) PCT No.: PCT/EP02/10676

§ 371 (c)(1),
(2), (4) Date: Aug. 18, 2004

(87) PCT Pub. No.: WO03/029603

PCT Pub. Date: Apr. 10, 2003

(65) Prior Publication Data

US 2007/0114037 A1 May 24, 2007

(30) Foreign Application Priority Data

Sep. 24, 2001 (EP) ..... 01308095

(51) Int. Cl.
*E21B 7/04* (2006.01)

(52) U.S. Cl. ..... 166/313; 166/50; 166/52; 166/117.5

(58) Field of Classification Search ..... 166/50, 166/52, 117.5, 313
See application file for complete search history.

(56) References Cited

U.S. PATENT DOCUMENTS

| | | | | |
|---|---|---|---|---|
| 4,924,949 | A | 5/1990 | Curlett | 175/25 |
| 5,520,252 | A | 5/1996 | McNair | 166/313 |
| 5,813,469 | A | 9/1998 | Bowlin | 166/369 |
| 6,065,550 | A | 5/2000 | Gardes | 175/62 |
| 6,125,937 | A | 10/2000 | Longbottom et al. | 166/313 |
| 6,189,616 | B1 | 2/2001 | Gano et al. | 166/298 |
| 6,457,540 | B2 * | 10/2002 | Gardes | 175/62 |

FOREIGN PATENT DOCUMENTS

| | | |
|---|---|---|
| EP | 0289673 | 11/1988 |
| EP | 0859123 | 8/1998 |
| GB | 2348223 | 9/2000 |
| WO | 00/63528 | 10/2000 |

* cited by examiner

*Primary Examiner*—William Neuder
*Assistant Examiner*—Nicole Coy

(57) ABSTRACT

A wellbore system for simultaneously drilling a wellbore into an earth formation and producing hydrocarbon fluid from the wellbore, is provided. The system comprises a production tubing extending into the wellbore and having a hydrocarbon fluid inlet arranged in a first part of the wellbore in fluid communication with a hydrocarbon fluid bearing zone of the earth formation, and a drilling riser extending through the production tubing and having a drilling fluid inlet in fluid communication with a second part of the wellbore, said second wellbore part being scaled from said first wellbore part. A drill string extends through the drilling riser and into said second wellbore part so as to allow further drilling of the wellbore.

11 Claims, 4 Drawing Sheets

WELLBORE SYSTEM FOR SIMULTANEOUS DRILLING AND PRODUCTION

FIELD OF THE INVENTION

The present invention relates to a wellbore system comprising a production tubing extending into the wellbore and having a hydrocarbon fluid inlet arranged in a first part of the wellbore in fluid communication with a hydrocarbon fluid bearing zone of the earth formation.

BACKGROUND OF THE INVENTION

Wellbore system have been devised for multi-lateral wellbores which include a main wellbore extending from surface into the earth formation and one or more branch boreholes extending laterally from the main borehole. Such multi-lateral wells have great potential for increased productivity and reservoir access per well as the number of wells in an oil/gas field development is significantly reduced. However drilling time on a multi-lateral well can be considerably increased compared to a conventional well, thus potentially significantly delaying first oil/gas production.

It is an object of the invention to provide an improved wellbore system which overcomes the afore-mentioned problem, and which enables to reduce the time until first oil/gas production.

SUMMARY OF THE INVENTION

In accordance with the invention there is provided a wellbore system for simultaneously drilling a wellbore into an earth formation and producing hydrocarbon fluid from the wellbore, comprising:

a production tubing extending into the wellbore and having a hydrocarbon fluid inlet arranged in a first part of the wellbore in fluid communication with a hydrocarbon fluid bearing zone of the earth formation;

a drilling riser extending through the production tubing and having a drilling fluid inlet in fluid communication with a second part of the wellbore, said second wellbore part being sealed from said first wellbore part;

a drill string extending through the drilling riser and into said second wellbore part so as to allow further drilling of the wellbore.

In this manner it is achieved that a stream of hydrocarbon fluid can be produced via an annular space formed between the drilling riser and the production tubing, and that a stream of drilling fluid simultaneously can flow from the lower end of the drill string via the drilling riser to surface, without intermixing of the two streams.

Suitably the wellbore includes a main borehole and at least one branch borehole extending away from the main borehole, said first and second wellbore parts being located in the main borehole, and wherein each branch borehole is in fluid communication with a selected one of said first and second wellbore parts.

For example, a first branch borehole is in fluid communication with the first wellbore part, which first branch borehole extends into the hydrocarbon fluid bearing zone, and/or a second branch borehole is in fluid communication with the second wellbore part, wherein the drill string extends into the second branch borehole.

It is preferred that the junction between the second branch borehole and the main borehole is located deeper along the main borehole than the junction between the first branch borehole and the main borehole.

Suitable said second wellbore part is sealed from said first wellbore part by means of a packer arranged between the drilling riser and the wellbore wall or a wellbore casing arranged in the wellbore.

BRIEF DESCRIPTION OF THE DRAWINGS

The invention will be described hereinafter in more detail and with reference to the accompanying drawings in which.

In the drawings like reference numerals relate to like components.

DETAILED DESCRIPTION OF THE INVENTION

Figure 1:
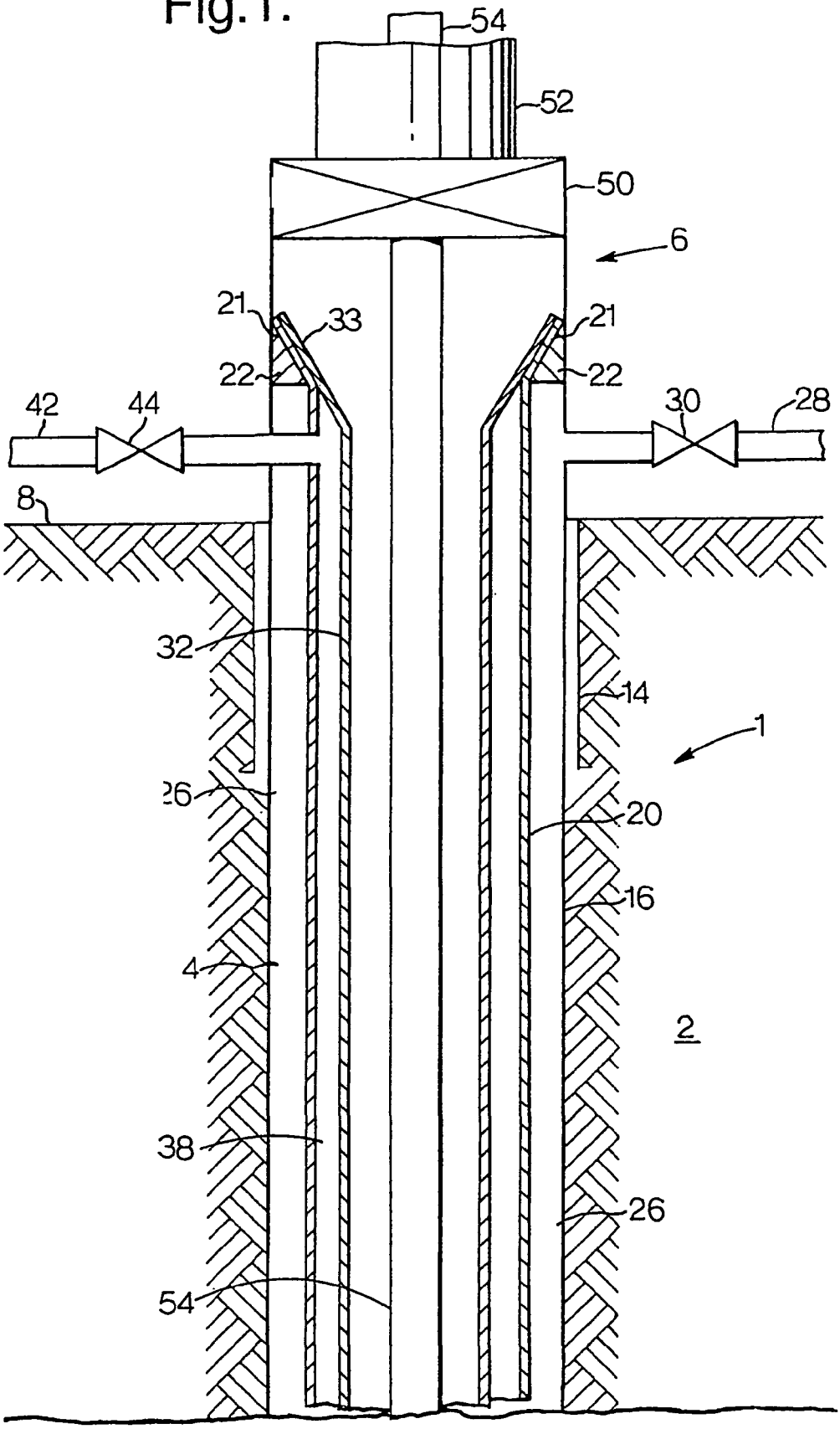
FIG. 1 schematically shows an upper part of an embodiment of the wellbore system of the invention.
Figure 2:
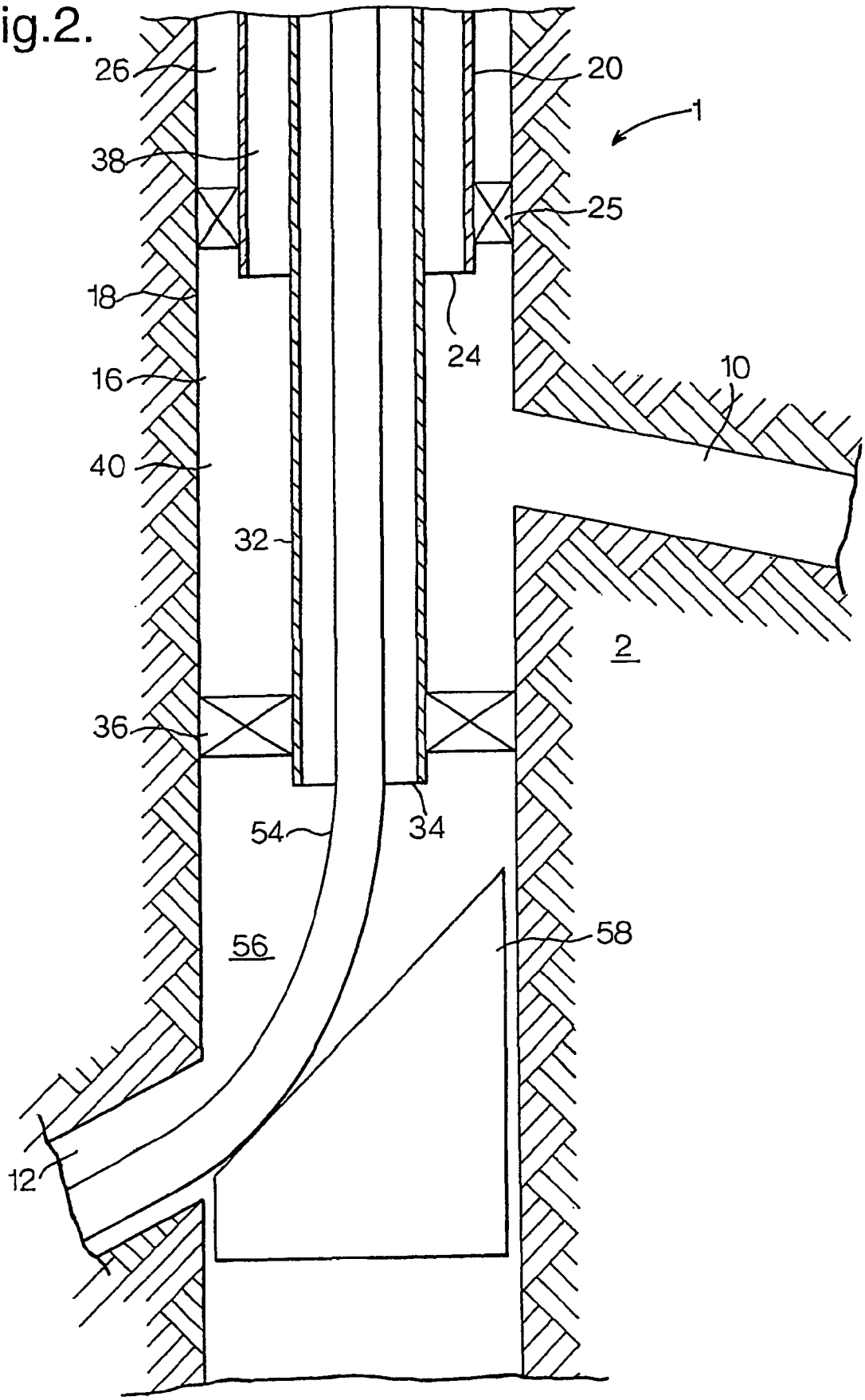
FIG. 2 schematically shows a lower part of the embodiment of FIG. 1.

Referring to FIGS. 1 and 2 there is shown a wellbore a formed into an earth formation 2. The wellbore 1 includes a main borehole 4 extending from a wellhead 6 at the earth surface 8, and two branch boreholes 10, 12 extending in lateral direction from the main borehole 4 at different depths. Branch borehole 10 extends into a hydrocarbon fluid bearing zone (not shown) of the earth formation 2, and branch borehole 12 is being drilled in the direction of the hydrocarbon fluid bearing zone. The main borehole 4 is provided with a surface casing 14 extending a relatively short distance into the formation 2, and a main casing 16 extending from the wellhead 6 to a lower part 18 of the main borehole 4.

A production tubing 20 of smaller diameter than the casing 16 extends into the main borehole 4, the tubing 20 having an outwardly flaring upper end 21 suspended at a tubing hanger 22 provided in wellhead 6. The tubing 20 has an open lower end 24 and is sealed to the casing,16 by means of a primary packer 25 arranged between a lower end part of the tubing 20 and the casing 16. An annular space 26 is defined between the production tubing 20 and the casing 16, which annular space 26 is filled with brine and is in fluid communication with a conduit 28 provided with a control valve 30 for controlling the amount of brine in the annular space 26.

A drilling riser 32 of smaller diameter than the production tubing 20 extends through tubing 20 to a certain distance below the lower end 24 thereof. The drilling riser 32 has an outwardly flaring upper end 33 suspended at the outwardly flaring upper end 21 of tubing 20, and an open lower end 34. A secondary packer 36 is arranged between a lower end part of the drilling riser 32 and the casing 16. An annular space 38 is defined between the drilling riser 32 and the production tubing 20, which annular space 38 continues into an annular space 40 between the drilling riser 32 and the casing 16. The annular space 40 is confined between primary and secondary packers 25, 36 and is in direct fluid communication with branch borehole 10. The annular space 38 is in fluid communication with a hydrocarbon fluid outlet 42 provided with control valve 44, arranged at the wellhead 6.

A blowout preventer (BOP) 50 is arranged on top of the wellhead 6, and a drilling fluid return conduit 52 extends from the BOP 50 to a shale shaker (not shown) and drilling fluid reservoir (not shown). A drill string 54 extends from a drilling rig (not show) via the drilling fluid return conduit 52, the BOP 50, and the drilling riser 32, into a portion 56 of the main borehole 4 below the drilling riser 32. A whipstock 58 is arranged in said wellbore portion 56 in a manner that the drill string 54 is guided by the whipstock 58 into the branch borehole 12.

Figure 3:
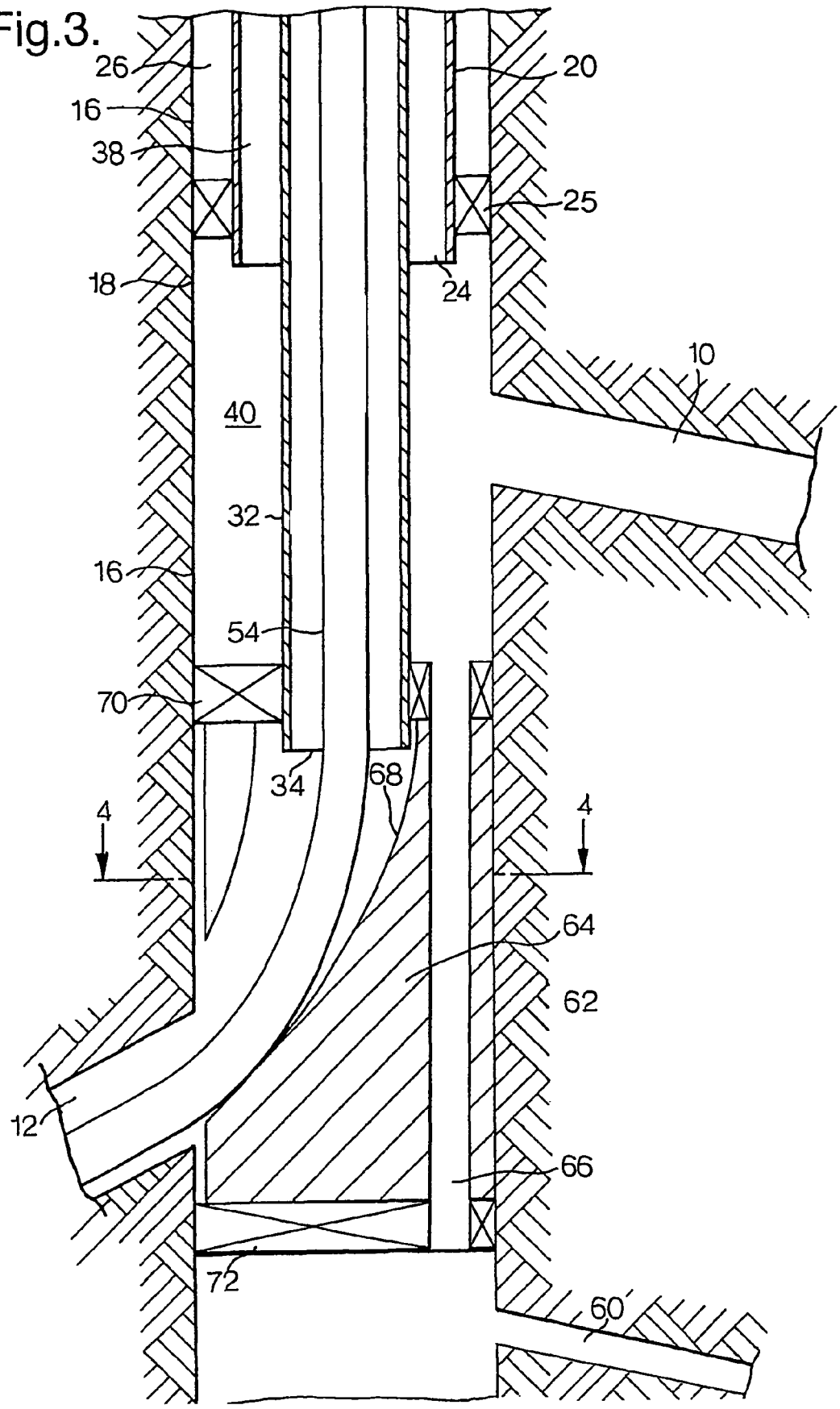
FIG. 3 schematically shows an alternative lower part of the embodiment of FIG. 1.
Figure 4:
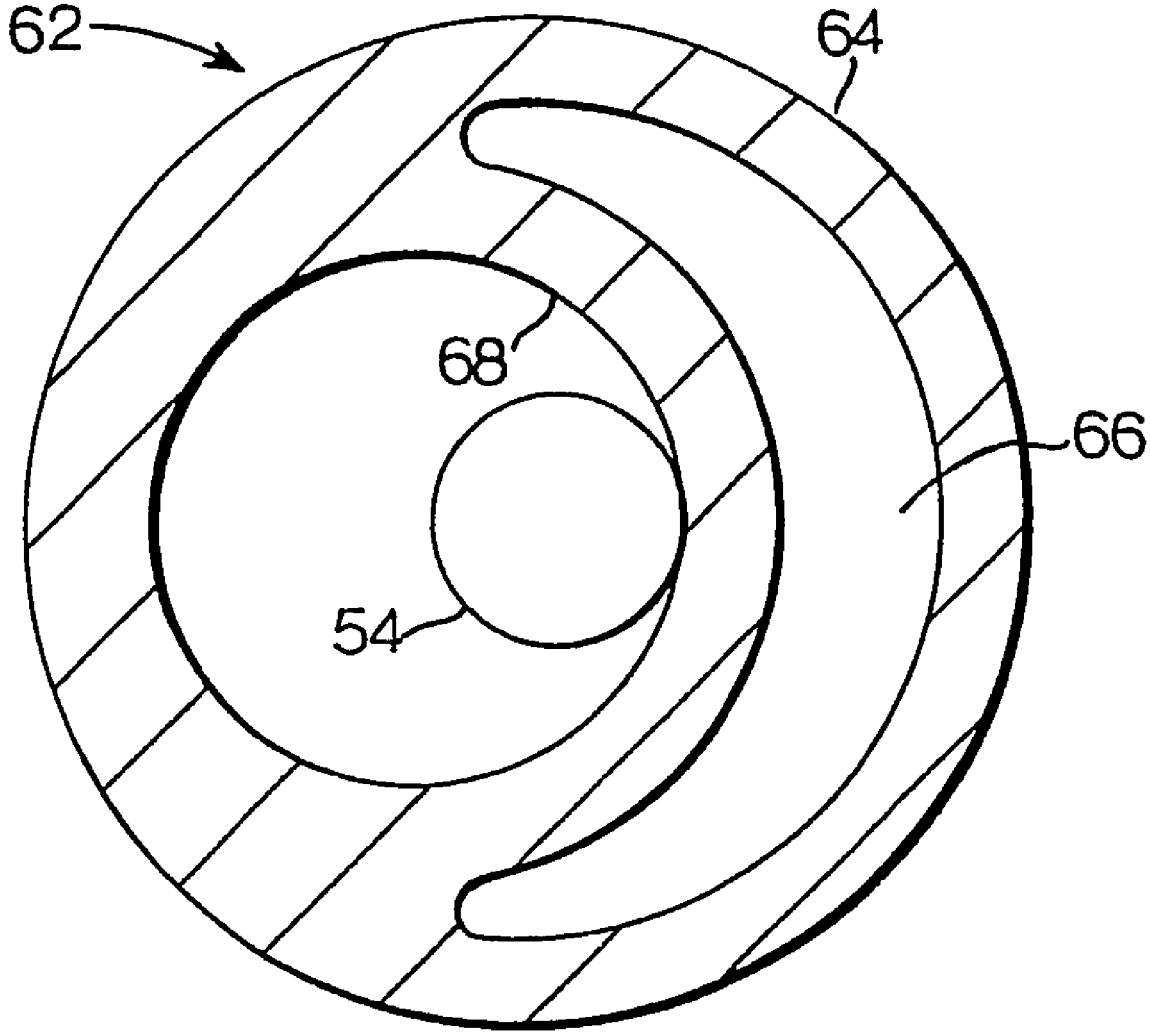
FIG. 4 schematically shows cross-section 4-4 of FIG. 3.

Referring to FIGS. 3 and 4 there is shown an alternative embodiment of the lower part of the wellbore system of the invention. In the alternative embodiment, the main borehole 4 is provided with a third branch borehole 60 extending into the hydrocarbon fluid bearing zone (or another hydrocarbon fluid bearing zone). Furthermore, the secondary packer 36 and the whipstock 58 have been replaced by an assembly 62 which includes a cylindrical body 64 having a longitudinal through passage 66 and a curved guide passage 68 oriented to guide the drill string 54 into the branch borehole 12. The cylindrical body 64 is at its upper end provided with an upper packer 70 arranged above the branch borehole 12, and at its lower end with a lower packer 72 arranged below the branch borehole 12, which packers 70, 72 seal the body 64 to the casing 16.

During normal operation of the embodiment of FIGS. 1 and 2, hydrocarbon fluid (e.g. crude oil) flows from the branch borehole 10 into the annular space 40, and from there into the open lower end of the production tubing 20. The hydrocarbon fluid flows upwardly through the annular space 38 in production tubing 20 and into the hydrocarbon fluid outlet 42 from which the fluid flows into a suitable hydrocarbon storage facility (not shown). The control valve 44 is used to control the flow rate of the stream of hydrocarbon fluid.

Simultaneously with the production of hydrocarbon fluid from branch borehole 10, the drill string 54 is rotated so as to further drill branch borehole 12. During the drilling process drilling fluid is pumped through the drill string 54 to the drill bit (not shown) at the lower end thereof. The drilling fluid entrains the drill cuttings in branch borehole 12 and flows via branch borehole 12 into the borehole portion 54, and from there into the open lower end 34 of drilling riser 32. The drilling fluid flows upwardly through the drilling riser 32, the BOP 50, and via the drilling fluid return conduit 52 to the shale shaker.

During normal operation of the alternative embodiment shown in FIGS. 1, 3 and 4, hydrocarbon fluid flows from the branch borehole 10 into the annular space 40. Simultaneously, hydrocarbon fluid flows from branch borehole 60 into the portion of the main borehole 4 below lower packer 72 and from there via through passage 66 into the annular space 40. The hydrocarbon fluid flows further into the open lower end of the production tubing 20 and via the annular space 38 into the hydrocarbon fluid outlet 42 from which the fluid flows into a suitable hydrocarbon storage facility (not shown). The control valve 44 is used to control the flow rate of the stream of hydrocarbon fluid.

Simultaneously with the production of hydrocarbon fluid from branch borehole 10, the drill string 54 is rotated so as to further drill branch borehole 12. During the drilling process drilling fluid is pumped through the drill string 54 to the drill bit (not shown) at the lower end thereof. The drilling fluid entrains the drill cuttings in branch borehole 12 and flows via branch borehole 12 into the guide passage 68, and from there into the open lower end 34 of drilling riser 32. The drilling fluid flows upwardly through the drilling riser 32, the BOP 50, and via the drilling fluid return conduit 52 to the shale shaker.

In this manner it is achieved that hydrocarbon fluid is produced from one or more portions of the wellbore, while simultaneously another portion of the wellbore is being drilled.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

We claim:

1. A wellbore system for simultaneously drilling a wellbore into an earth formation and producing hydrocarbon fluid from the wellbore, comprising:

a production tubing extending into the wellbore and having a hydrocarbon fluid inlet arranged in a first part of the wellbore in fluid communication with a hydrocarbon fluid bearing zone of the earth formation;

a drilling riser extending through the production tubing and having a drilling fluid inlet in fluid communication with a second part of the wellbore, said second wellbore part being sealed from said first wellbore part; and a drill string extending through the drilling riser and into said second wellbore part so as to allow further drilling of the wellbore.

2. The wellbore system of claim 1, wherein the wellbore includes a main borehole and at least one branch borehole drilled away from the main borehole, said first and second wellbore parts being located in the main borehole, and wherein each branch borehole is in fluid communication with a selected one of said first and second wellbore parts.

3. The wellbore system of claim 2, wherein the wellbore includes a first branch borehole in fluid communication with the first wellbore part, the first branch borehole extending into the hydrocarbon fluid bearing zone.

4. The wellbore system of claim 2, wherein the wellbore includes a second branch borehole in fluid communication with the second wellbore part, and wherein the drill string extends into the second branch borehole.

5. The wellbore system of claim 4, wherein the junction between the second branch borehole and the main borehole is located deeper along the main borehole than the junction between the first branch borehole and the main borehole.

6. The wellbore system of claim 1, wherein said second wellbore part is sealed from said first wellbore part by means of a packer arranged between the drilling riser and the wellbore wall or a wellbore casing arranged in the wellbore.

7. The wellbore system of claim 1, wherein the wellbore includes a third wellbore part in fluid communication with the hydrocarbon fluid bearing zone, the third wellbore part being in fluid communication with the first wellbore part and sealed from the second wellbore part.

8. The wellbore system of claim 7, wherein the second wellbore part is located between the first and third wellbore parts.

9. The wellbore system of claim 8, wherein the first and third wellbore parts are in fluid communication with each other by means of a tubular member extending through the second wellbore part.

10. The wellbore system of claim 9, wherein opposite end parts of the tubular member are sealed to the wellbore wall or to a wellbore casing by means of respective packers.

11. The wellbore system of claim 8, wherein the tubular member is provided with a guide surface for guiding the drill string into a selected direction so as to allow further drilling of the wellbore in the selected direction.

* * * * *